US006032734A

United States Patent [19]

Telfer

[11] Patent Number: 6,032,734

[45] Date of Patent: Mar. 7, 2000

[54] ACTIVATING MEANS FOR A DOWN-HOLE TOOL

[75] Inventor: George Telfer, Aberdeen, United Kingdom

[73] Assignee: Weatherford/Lamb, Inc., Houston, Tex.

[21] Appl. No.: 08/952,844

[22] PCT Filed: May 30, 1996

[86] PCT No.: PCT/GB96/01275

§ 371 Date: Nov. 19, 1997

§ 102(e) Date: Nov. 19, 1997

[87] PCT Pub. No.: WO96/38649

PCT Pub. Date: Dec. 5, 1996

[30] Foreign Application Priority Data

May 31, 1995 [GB] United Kingdom ..... 9510923
Jul. 27, 1995 [GB] United Kingdom ..... 9515419

[51] Int. Cl.[7] ..... E21B 43/00

[52] U.S. Cl. ..... 166/66.5; 166/106; 166/120; 166/321; 166/374; 166/382

[58] Field of Search ..... 166/65.1, 66.5, 166/106, 120, 217, 319, 321, 374, 382, 387

[56] References Cited

U.S. PATENT DOCUMENTS

| | | | |
|---|---|---|---|
| Re. 30,988 | 7/1982 | Crickmer | 166/217 |
| 2,315,931 | 4/1943 | Burt et al. . | |
| 2,842,209 | 7/1958 | Gibson . | |
| 3,086,589 | 4/1963 | McGowen . | |
| 3,105,551 | 10/1963 | Ehlert . | |
| 3,485,299 | 12/1969 | Young . | |
| 4,047,565 | 9/1977 | Crickmer | 166/217 |
| 4,058,166 | 11/1977 | Crickmer | 166/315 |
| 4,161,215 | 7/1979 | Bourne | 166/65 M |
| 5,273,116 | 12/1993 | Ross | 166/302 |
| 5,472,055 | 12/1995 | Simson et al. | 166/382 |
| 5,666,050 | 9/1997 | Boudlin et al. | 324/207 |

FOREIGN PATENT DOCUMENTS

| | | |
|---|---|---|
| 2099888 | 12/1982 | United Kingdom . |
| 2240376 | 7/1991 | United Kingdom . |

*Primary Examiner*—Roger Schoeppel
*Attorney, Agent, or Firm*—Guy McClung

[57] ABSTRACT

An activating means for activating a down-hole tool incorporates a magnet, which may include an attracting magnet (12) and a repelling magnet (13), and which may move under hydraulic pressure from an active position at which it causes a trigger, valve (8) or spring to be energised to a non active position at which the tool is not activated, the activating means thereby utilising hydraulic pressure without requiring hydraulic ports in the liner or mandrel.

11 Claims, 3 Drawing Sheets

ACTIVATING MEANS FOR A DOWN-HOLE TOOL

This invention relates to activation means, particularly, although not essentially, for use in off-shore drilling apparatus, including liner hangers, packers and other down-hole tools.

Liner hangers are used for running, setting and anchoring a liner or casing in a subterranean gas or oil well. In the past, they have operated both mechanically and hydraulically. Traditionally, mechanical liner hangers have comprised leaf springs and a "J" slot mechanism. The leaf springs have been required to be fragile, due to restricted space between the exterior of the liner hanger and the interior of the casing, and thus these have been easily damaged. Also, the "J" slot mechanism is frequently difficult to activate in view of drag forces required to be overcome.

Hydraulically activated liner hanger units have therefore become more common. With these, one or more rows of slips are urged by pressurised hydraulic fluid into engagement with respective cones or cone segments positioned on the liner or on a sleeve surrounding the liner. The hydraulic fluid is supplied through an appropriate channel inside the liner and, at some point, is caused to pass through a small bore or port in the liner to a hydraulic cylinder or the like on the outside of the liner. The provision of this bore, however, although necessary for the supply of fluid, often is disadvantageous in that it may become clogged, or it may leak undesirably.

Hydraulic ports of a similar nature, and associated with similar problems, have been required for other apparatus which are activated hydraulically.

An object of the present invention is to provide a magnetic activating means for activating a liner hanger, packer or other down-hole equipment without the need for hydraulic ports, notwithstanding the use of hydraulic fluid.

According to the present invention there is provided an activating means for activating a down-hole tool, the activating means comprising a spring which, in use, is energised to cause (in the absence of obstruction) activation of the tool, an obstruction means moveable between an obstructing position where activation of the tool is obstructed and a non obstructing position where activation of the tool is enabled, wherein movement of the obstructing means is caused by a magnet, the-magnet itself being operably moveable between a remote location and an active location at which magnetic force derived from the magnet causes movement of the obstructing means to the non obstructing position, in turn causing the spring to encourage activation of the tool.

Preferably, the magnet is moved under hydraulic pressure.

The down-hole tool may be a liner hanger, a packer or other equipment.

The spring may be a mechanical spring or a hydraulic piston or cylinder, or a combination of such apparatus.

Also according to the invention there is provided an activation means for activating a down-hole tool located on or near the external face of a liner or mandrel, the activation means comprising a magnet located internally of the liner or mandrel, a compressed spring and a hydraulic cylinder located externally of the liner or mandrel, the cylinder including a valve means to facilitate the controllable release of hydraulic fluid from the cylinder when the valve means is opened, the valve means being biased in a closed position but caused to open when acted upon by a magnetic force derived from the magnet, wherein release of hydraulic fluid from the cylinder causes the spring to move the cylinder to effect activation of the tool.

Preferably, the magnet comprises a spaced apart attracting magnet and repelling magnet. The attracting magnet may be used to bias the valve means in a closed position and the attracting magnet may be used to open the valve means. The attracting magnet may be rigidly linked to the repelling magnet such that movement of the repelling magnet into close proximity to the valve means causes a corresponding movement of the attracting magnet away from the valve means. Movement of the magnet may be effected hydraulically.

Also according to the present invention there is provided liner hanging apparatus for hanging a liner in a well bore comprising one or more cone segments mounted on the liner and one or more respective slips mounted on the liner and adapted upon slidable upward movement to engage with the cone segments to cause outward expansion of the slips and setting of the liner, wherein the upward movement of the slips is encouraged by a compressive spring acting between the liner below the slips and the slips, wherein the upward movement of the slips is physically prevented by a trigger member when the trigger member is in a first position but enabled when the trigger member is in a second position, the trigger member being biased toward the first position while moveable to the second position when acted upon by a magnetic force derived from a magnet located inside the liner.

Preferably, the trigger member comprises a pin hingeably attached to a said slip. When the trigger member is in the first position, it preferably is caused to foul or nest on or in a respective shoulder on the external side of the liner.

Preferably, the magnet is a cylindrical repelling magnet located in an annular channel in a running tool positioned internally of the liner. The magnet is preferably slidable within the channel under pressurised fluid from a non active first position to an active second position at which the magnet repels the trigger member outward to such extent that the trigger does not foul on the liner and the slips are free to slide vertically upward.

The magnet may be held in the non-active position until the liner is at the setting depth by a shear pin connecting the magnet with the annular channel wall. Preferably, a closure member is provided to close the flow path of the fluid within the running tool and to divert the fluid into the channel when it is sought to move the magnet to the active position. The closure member may be a ball dropped on to a ball seat held in the running tool.

Embodiments of the invention will now be described by way of example only with reference to the accompanying figures, in which.

Figure 1:
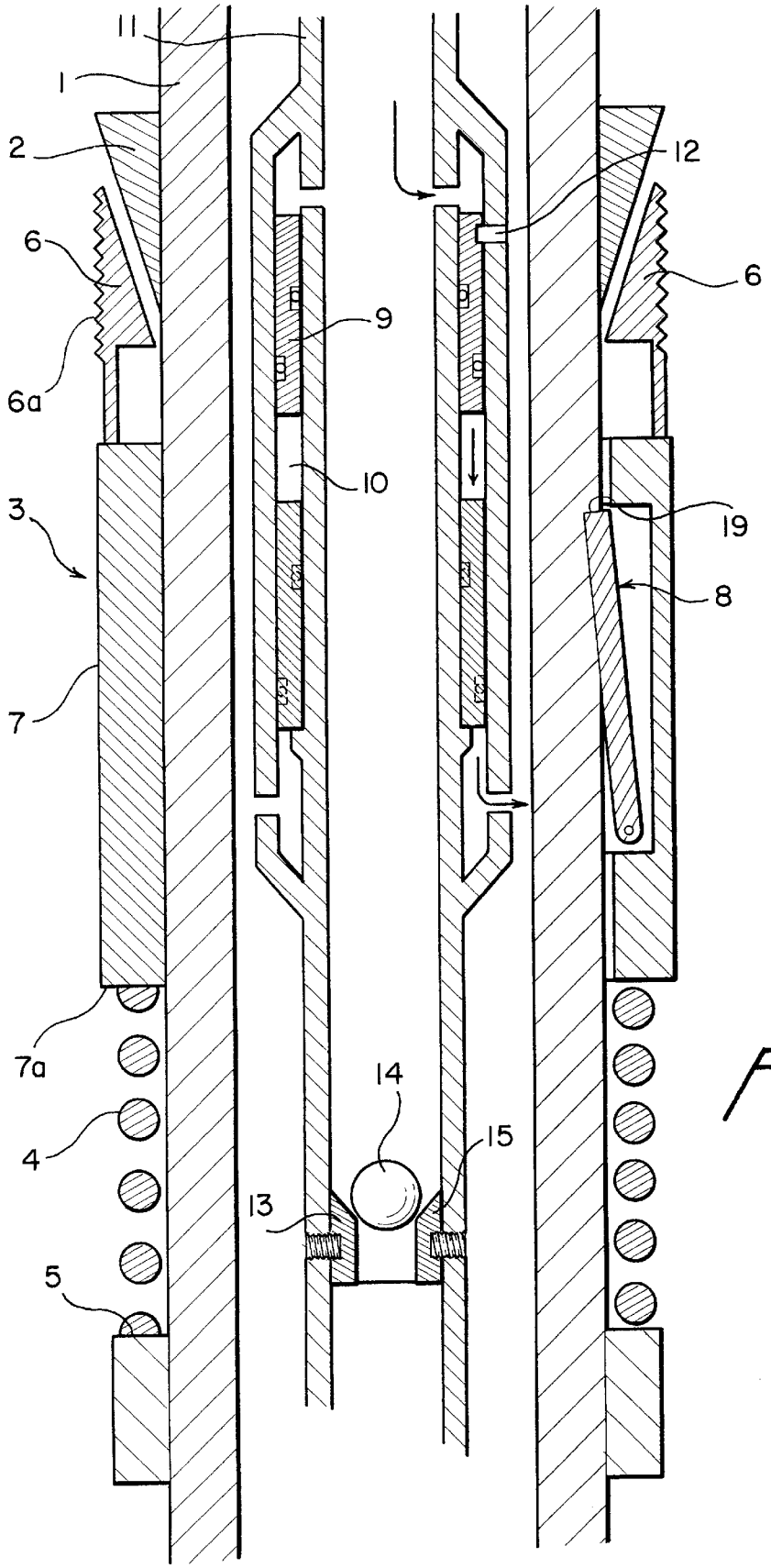
FIG. 1 is a sectional elevation of liner hanger apparatus incorporating the invention.

In FIG. 1 a liner 1 is located in a well bore. The liner 1 supports a plurality of cone segments 2, which in this embodiment are integrally attached to the exterior wall of the liner 1. It is not essential to the invention however, that this be the case, and the inclusion of a rotatable sleeve supporting the segments 2 may be incorporated.

Slips 3, having a tapered head portion 6 and a sleeve portion 7 are provided around the liner 1, the slips 3 being vertically slidable such that their tapered portion 6 may engage with the cone segments 2. This engagement causes the slips 6 to be pushed outwardly until the toothed face 6a of the slips 3 grips securely on the well casing (not shown).

A spring 4 is located between a shoulder 5 integral with the liner 1 and the lower face 7*a* of the sleeve portion 7 on the slips 3. The spring 4 is loaded with a compressive force; thereby encouraging the slips 3 upwardly relative to the liner 1 and the cone segments 2. However, the slips 3 are impeded from travelling upwardly and setting the tool until such time as this is desired by a trigger member 8 located within and pivotally attached to the sleeve portion 7 which is biased to a first position where at it is illustrated in the accompanying Figure. When at the first position the trigger member 8 nests in a receptive cut out portion in the wall of the liner 1 and upward movement of the sleeve is prohibited by fouling of the trigger 8 on the shoulder 9 of the cut out portion of the liner 1.

A magnet 9 slidably located in a channel 10 in the running tool 11 is provided to move the trigger member 8 into a second position when desired. The magnet, which in the embodiment shown is a repelling magnet in the form of an annular piston, is held at the top of the channel 10 by a shear pin 12 until the liner is in the desired setting position. While the magnet 9 is at the top of the channel 10 it does not significantly act upon the trigger member 8, and the trigger 8 therefore remains in the first position preventing upward movement of the slips 3.

Then, when the setting position is reached, fluid travelling down the internal bore within the running tool 11 is dammed by a closure member 13, which in this embodiment comprises a ball 14 resting on a seat 15. The fluid path is thereby diverted into the channel 10 and causes the pin 12 to shear and the magnet 9 to slide down the channel 10 into an active position; that being a position where it actively repels the trigger member 8 causing the trigger to pivot to its second position clear of the liner wall. The compressive force of the spring 4 then pushes the slip 3 upwardly and into engagement with the cone segments 2.

Figure 2:
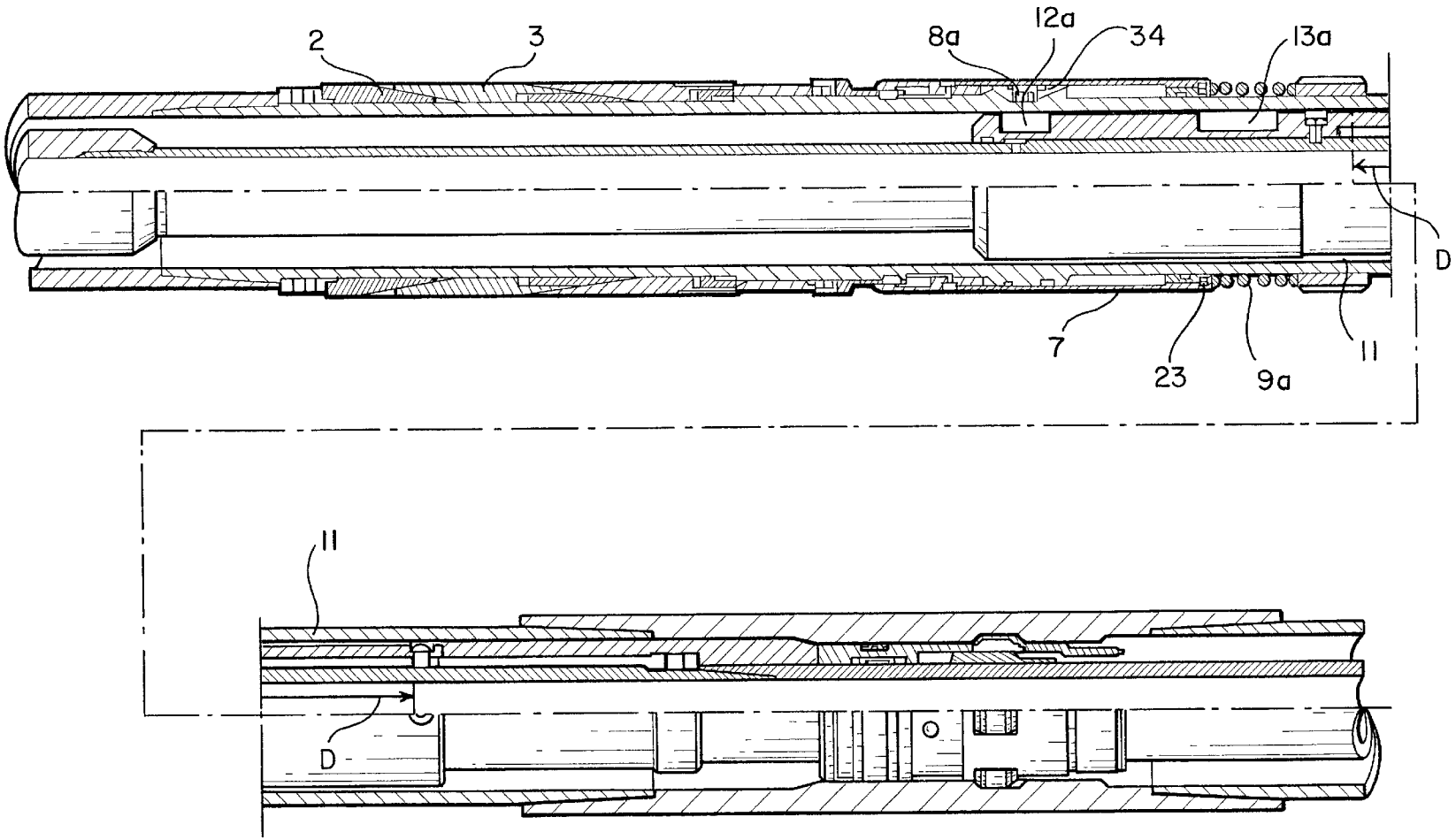
FIG. 2 is a further elevation of liner hanger apparatus incorporating the invention in an alternative and preferred form.
Figure 2A:
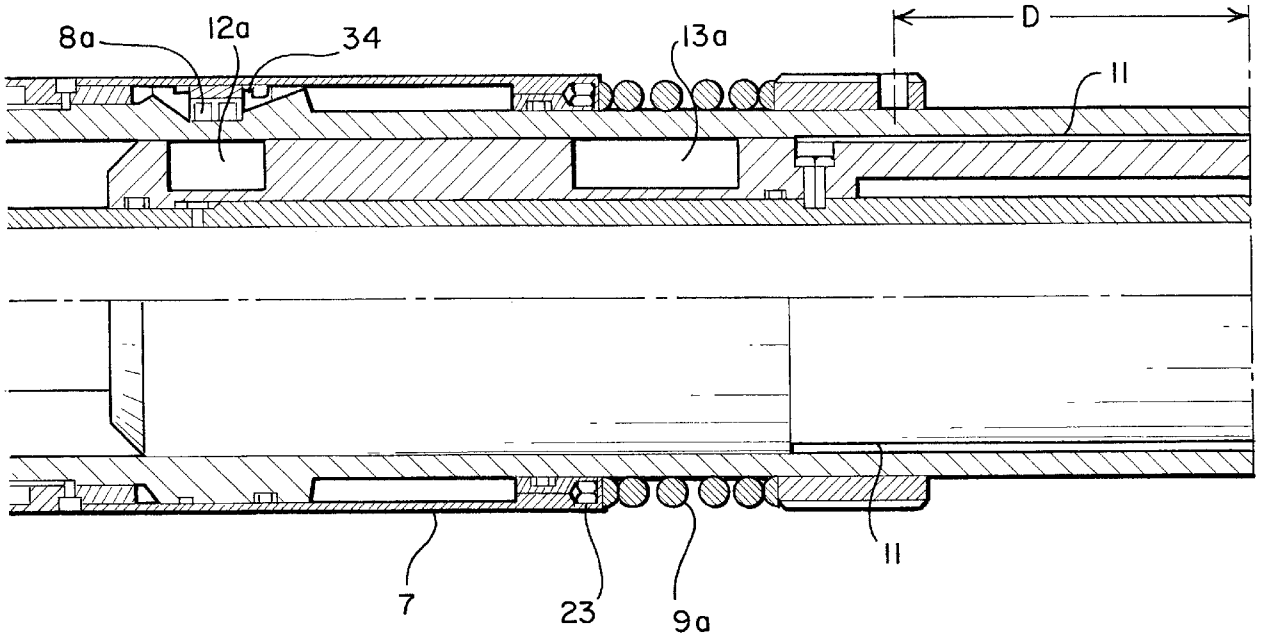
FIG. 2A shows an enlarged view of a portion ot the apparatus of FIG. 2

An alternative embodiment is illustrated in FIG. 2. Here, a spring 9*a* is energised in compression and acts upon the hydraulic cylinder 7. The cylinder 7 is provided with hydraulic fluid through an inlet which is thereafter plugged by the plug 23. The fluid, under pressure, resists movement of the cylinder 7 notwithstanding the force applied to the cylinder 7 by the spring 9*a*.

A magnet housing 11 is located internally of the liner and carries an attracting magnet 12*a*, and a repelling magnet 13*a*. The magnet housing 11 is slidable within the liner by the distance "D". When the housing is located as shown in FIG. 2, the attracting magnet 12*a* attracts the magnetic poppet 8*a* housed in the O-ring 34.

The poppet 8*a* acts as a valve means when so attracted preventing the escape of hydraulic fluid from the cylinder 7. However, upon the movement of the magnet housing 11 through the distance D, the repelling magnet 13*a* moves to the position previously occupied by the attracting magnet 12*a* (which itself moves away) which, in turn, repels the poppet 8*a* outward against the frictional resistance of the O-ring 34, thereby opening the valve means and allowing the escape of hydraulic fluid. The spring force then succeeds in moving the cylinder up the liner, acting on the liner hanger arrangement with the effect of causing the slips 3 to slide up the cones 2, setting the liner.

Figure 3:
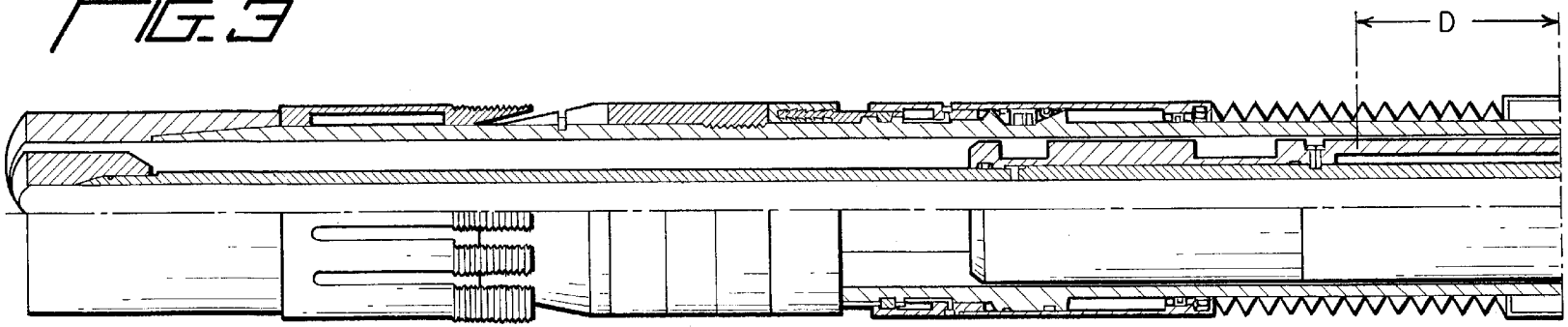
FIG. 3 is a further elevation of down-hole packer incorporating an embodiment of the invention.

The embodiment illustrated in FIG. 3 represents how the invention may be applied with similar effect in relation to a packer. In this case the liner hanger is replaced by a packer, and alternative spring and/or magnet characteristics may be employed.

The invention thus negates the need for small bores a through the liner to facilitate the supply of hydraulic fluid, while still not requiring the demanding physical requirements associated with purely mechanical liner hangers and other down-hole tools. It also facilitates the use of relatively small outside diameters and allows for enhanced bypass areas, with lesser flow impedance.

Further modifications may be incorporated without departing from the scope of the invention herein intended.

I claim:

1. An activation means for activating a down-hole tool located on or near the external face of a liner or mandrel, the activation means comprising a magnet located internally of the liner or mandrel, a compressed spring and a hydraulic cylinder located externally of the liner or mandrel, the cylinder including a valve means to facilitate the controllable release of hydraulic fluid from the cylinder when the valve means is opened, the valve means being biased in a closed position but caused to open when acted upon by a magnetic force derived from the magnet, wherein release of hydraulic fluid from the cylinder causes the spring to move the cylinder to effect activation of the tool, wherein the magnet comprises a spaced apart attracting magnet and repelling magnet.

2. An activating means according to claim 1 wherein the attracting magnet may be used to bias the valve means in a closed position and the attracting magnet may be used to open the valve means.

3. An activating means according to claim 1 wherein the attracting magnet is rigidly linked to the repelling magnet such that movement of the repelling magnet into close proximity to the valve means causes a corresponding movement of the attracting magnet away from the valve means.

4. An activating means according to claim 1 wherein movement of the magnet may be effected hydraulically.

5. Liner hanging apparatus for hanging a liner in a wellbore comprising one or more cone segments mounted on the liner and one or more respective slips mounted on the liner and adapted upon slidable upward movement to engage with the cone segments to cause outward expansion of the slips and setting of the liner, wherein the upward movement of the slips is encouraged by a compressive spring acting between the liner below the slips and the slips, wherein the upward movement of the slips is physically prevented by a trigger member when the trigger member is in a first position but enabled when the trigger member is in a second position, the trigger member being biased toward the first position while movable to the second position when acted upon by a magnetic force derived from a magnet located inside the liner, wherein the trigger member comprises a pin hingeably attached to a said slip.

6. Liner hanging apparatus as claimed in claim 5 wherein the trigger member is in the first position, it is caused to foul or nest on or in a respective shoulder on the external side of the liner.

7. Liner hanging apparatus as claimed in claim 5 wherein the magnet is a cylindrical repelling magnet located in an annular channel in a running tool positioned internally of the liner.

8. Liner hanging apparatus as claimed in claim 5 wherein the magnet is slidable within the channel under pressurised fluid from a non active first position to an active second position at which the magnet repels the trigger member outward to such extent that the trigger does not foul on the liner and the slips are free to slide vertically upward.

9. Liner hanging apparatus as claimed in claim 5 wherein the magnet is held in the non-active position until the liner is at the setting depth by a shear pin connecting the magnet with the annular channel wall.

10. Liner hanging apparatus as claimed in claim 5 wherein a closure member is provided to close the flow path of the fluid within the running tool and to divert the fluid into the channel when it is sought to move the magnet to the active position.

11. Liner hanging apparatus as claimed in claim 10 wherein the closure member is a ball dropped on to a ball seat held in the running tool.

* * * * *